United States Patent [19]

Nigro

[11] 3,998,238

[45] Dec. 21, 1976

[54] CHIP-DISPENSING DEVICE

[75] Inventor: George A. Nigro, Chicago, Ill.

[73] Assignee: Rodney L. Griffin, Chicago, Ill. ; a part interest

[22] Filed: Aug. 11, 1975

[21] Appl. No.: 603,277

Related U.S. Application Data

[63] Continuation of Ser. No. 466,002, May 1, 1974, abandoned.

[52] U.S. Cl. ..... 133/5 A; 221/297; 221/279

[51] Int. Cl.[2] ..... G07D 1/00

[58] Field of Search ..... 133/5 R, 5 A, 6; 221/297, 279, 310; 206/.8, .82, .83, .84, 445

[56] References Cited

UNITED STATES PATENTS

| | | | |
|---|---|---|---|
| 2,747,768 | 5/1956 | Raines | 221/310 X |
| 3,112,046 | 11/1963 | Szekely | 221/279 X |
| 3,228,556 | 1/1966 | Nonestied | 221/279 |
| 3,346,109 | 10/1967 | Duran | 206/.82 |
| 3,586,210 | 6/1971 | Andamasaris | 133/5 A X |

*Primary Examiner*—Robert B. Reeves
*Assistant Examiner*—Joseph J. Rolla
*Attorney, Agent, or Firm*—Norman H. Gerlach

[57] ABSTRACT

A portable storing and dispensing device for chips, coins, or other disk-like members and embodying an elongated rigid chip-containing magazine which is adapted to store active and reserve chips in stacked relationship and has an open lower end through which the chips are successively dispensed. A flexible expansible gate mechanism restrains the active chips within the magazine and a plunger which is completely encased within the magazine is effective upon depression thereof to effect unit-chip displacement past said gate mechanism at a selected location on a playing board or the like. In a modified form of the device, the magazine contains only active chips and the plunger is telescopically received within the magazine so that its upper portion projects above the upper rim of the magazine for direct manipulation by the user of the device.

3 Claims, 7 Drawing Figures

CHIP-DISPENSING DEVICE

This application is a continuation of my patent application Ser. No. 466,002, filed on May 1, 1974, now abandoned, and entitled, "Chip-Dispensing Device."

PERTINENT PRIOR ART
(United States Patents)

| | | | |
|---|---|---|---|
| Hunter | 2,431,121 | Nov. 18, 1947 | 133—5 |

OTHER ART OF INTEREST
(United States Patents)

| | | | |
|---|---|---|---|
| McDonald et al. | 2,520,321 | Aug. 29, 1950 | 133—5 |
| Miotke | 3,186,593 | June 1, 1965 | 221—297 |
| Andamasaris | 3,586,210 | June 22, 1972 | 221—290 |
| Rocheleau | 3,765,429 | Oct. 16, 1973 | 133—5A |

The improved storing and dispensing device comprising the present invention is designed primarily for use in connection with the playing of games such as Bingo, Keno, Lotto and the like in which chips, disks, markers, or other tokens are used. Accordingly, the present dispensing device as illustrated in the accompanying drawings and described herein is designed for the unit-dispensing of chips at selected locations on a playing board, card, or the like. The invention is, however, capable of other uses and a dispensing device embodying the principles of the present invention may, if desired and with or without modification, be employed for the unit dispensing of other articles such as coins, washers, pills, or the like. Irrespective, however, of the particular use to which the invention may be put, the essential features thereof are at all times preserved.

The invention is particularly concerned with that type of storing and dispensing device wherein the chips to be dispensed are enclosed in stacked relationship in an elongated, tubular, normally upright magazine having the lower end thereof provided with a plurality of spring fingers which, collectively, constitute a gate for restraining the chips within the magazine, and wherein when the device as a whole is manipulated into a vertical position on a playing board and downward pressure is applied to the upper end of the stack of active chips, the gate is caused to open and deliver a unit chip to such playing board.

Chip-dispensing devices of this general type are divided into two classes. In one class, downward pressure upon a plunger which is associated with the device causes the spring fingers at the lower end of the magazine to be spread apart, thus allowing a unit chip to fall by gravity onto the playing surface. In the other class, downward pressure on a plunger forces the stack of chips bodily downwardly so that the lowermost chip in the stack, by a camming action, spreads apart the spring fingers so as to admit a unit chip through the gate for deposition on the playing board.

The first class of device as outlined above is possessed of the obvious limitation that spreading apart of the spring fingers, in connection with opening of the gate, will not necessarily insure the passage of a unit chip by gravity downwardly through such gate. If the chips are not tightly stacked within the magazine as, for example, when the supply of chips is nearly depleted, an angularly displaced chip at the bottom of the stack may bind against the wall of the magazine or against the surface on which it is to be deposited so that it will not pass completely through the gate. Furthermore, because Bingo chips and the like are usually in the form of small thin plastic wafers having little weight, binding of the stack of chips within the magazine due to the presence of dirt or other foreign material adhering to the wall of the magazine will prevent dispensing of a chip.

The second class of device as outlined above is possessed of the limitation that the spring fingers which collectively constitute the gate are integrally formed on the magazine wall and, themselves, define the lower rim of the magazine, and consequently, when the magazine is set in position on a playing board and the plunger is depressed so that the stack of chips is forced downwardly to spread apart the spring fingers and open the gate, such fingers slide radially outwardly on the top surface of the playing board with considerable downward pressure. If the frictional characteristics between the ends of the spring fingers and the top surface of the playing board are great, such fingers may not open evenly with the result that the lowermost chip in the stack will not be forced through the gate. Also, if the top surface of the playing board is paper, cloth or the like, rupture of such playing surface may take place, or a card on which the chip is to be deposited may be scratched, ruptured or otherwise defaced. Under extreme conditions, when the pressure of the plunger is released, the card or cloth paying surface may actually be picked up by the device when it is withdrawn from the playing location.

The present invention is designed to overcome the above-noted limitations that are attendant upon the construction and use of present-day chip-dispensing devices of the character under consideration and, toward this end, the invention contemplates the provision of a chip-dispensing device wherein the spring fingers which establish the dispensing gate at the lower end of the magazine are spaced upwardly from the rigid lower rim of the tubular magazine so that upon outward radial spreading thereof they completely clear the playing surface on which the magazine rests. Furthermore, the clearance distance above the lower rim of the magazine is substantially equal to the thickness of a single chip so that after a chip has been dispensed and the spring fingers return to their normal positions, they will underlie the next adjacent chip in the stack and thus support the entire stack of chips in a slightly elevated position.

The chip-dispensing device of the present invention is of the second class as outlined above wherein plunger pressure is applied to the entire stack of chips to force the chips one at a time through the yieldable gets arrangement or mechanism. In the preferred form of the invention, the plunger is substantially wholly disposed within the chip-containing magazine and a manipulating handle projects outwardly through a vertical slot in the magazine wall. By such an arrangement, the plunger is protected from contamination by dirt, other foreign material, or candy residue on the fingers of the user which otherwise might cause binding of the plunger within the magazine as is the case with conventional chip-dispensing devices. Furthermore, the encasing of the plunger within the magazine allows for a magazine division wherein active chips may be disposed in the magazine below the plunger and a supply of reserve chips disposed in the magazine above the plunger.

In a modified form of the invention, such encasing of the plunger wholly within the magazine is not resorted to, but the aforementioned gate arrangement of mechanism wherein the gate fingers are maintained out of contact with the playing surface is maintained.

The provision of a chip-dispensing device such as has briefly been outlined above and possessing the stated advantages constitutes the principal object of the present invention.

Other objects of the invention and the various characteristics and advantages of the present chip-dispensing device will be apparent from a consideration of the following detailed description.

The invention consists in the several novel features which are hereinafter set forth and are more particularly defined by the claims at the conclusion hereof.

In the accompanying single sheet of drawings forming a part of this specification, two illustrative embodiments of the invention are shown. In these drawings.

Figure 2:
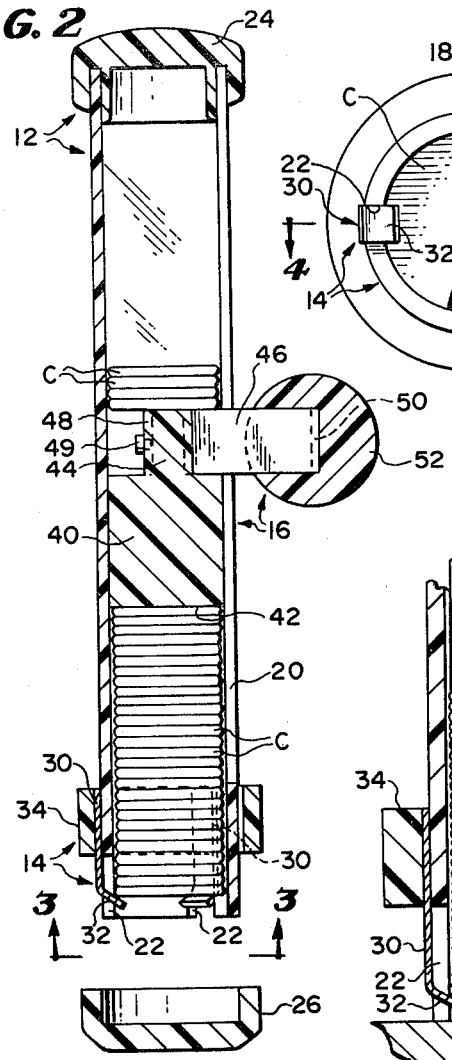
FIG. 2 is a sectional view taken substantially centrally and longitudinally through the dispensing device of FIG. 1 when the latter is in its assembled condition but with the bottom retainer cap removed.
Figure 6:
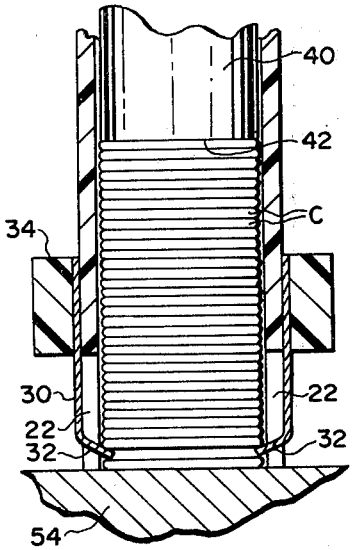
Figure 7:
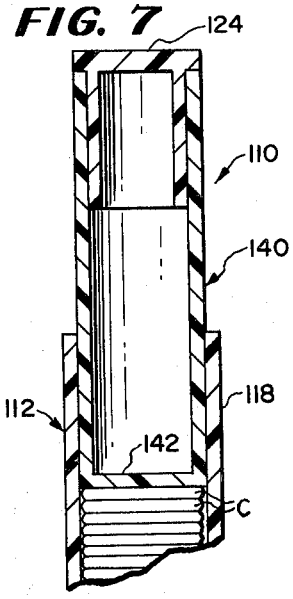
Figure 5:
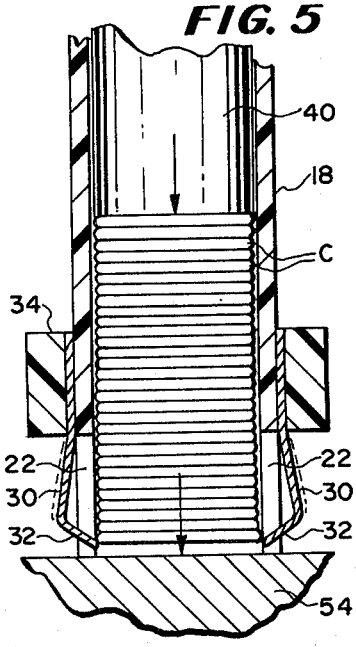
FIG. 5 is a fragmentary sectional view similar to FIG. 4 but showing the plunger in its depressed position with the chips under compression.

FIG. 6 is a fragmentary sectional view similar to FIG. 5 but showing the position of the plunger and magazine-contained chips immediately after a chip has been dispensed and directly prior to withdrawal of the dispenser from the subjacent playing surface; and FIG. 7 is a fragmentary central longitudinal sectional view similar to FIG. 2 but showing a slightly modified form or embodiment of the invention and embodying a different form of actuating plunger.

Figure 1:
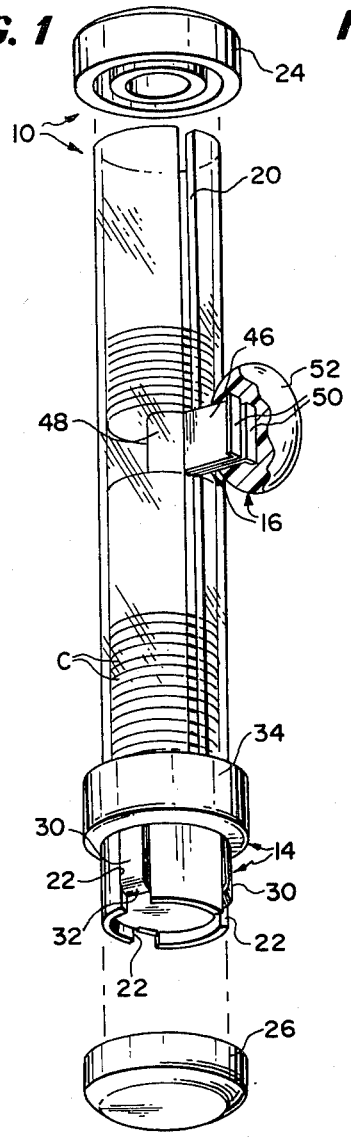
FIG. 1 is an exploded perspective view of one form or embodiment of a chip-dispensing device constructed according to the principles of the present invention and showing the same partially filled with chips.
Figure 3:
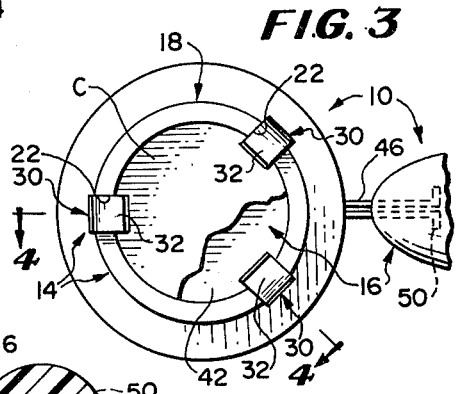
FIG. 3 is an enlarged bottom end view of the structure shown in FIG. 2, the view being taken on the line 3--3 of FIG. 2 and in the direction of the arrows.

Referring now to the drawings in detail and in particular to FIGS. 1 to 3, inclusive, a chip-dispensing device embodying the present invention in its preferred form or embodiment is designated in its entirety by the reference numeral 10 and it is compreised of three principal components, namely, a magazine 12, a gate assembly 14, and a plunger assembly 16.

The magazine of the device 10 is in the form of an elongated tubular casing 18 which may be formed of metal or a suitable plastic, preferably transparent, and it has formed therein a narrow vertical or longitudinal slot 20, the slot extending from a point near the gate assembly 14 upwardly to the upper rim of the magazine. The magazine is further provided with a series of three vertical notches 22 in the lower region thereof, such notches preferably, but not necessarily, being three in number and being equally spaced about the lower rim of the magazine. These notches 22 extend upwardly from such lower rim of the magazine to a point adjacent to a region which is encompassed by the gate assembly 14 and are provided for a purpose that will be made clear presently. Removable top and bottom closure caps 24 and 26, preferably of plastic or elastomeric material, complete the magazine 12.

The gate mechanism 14 of the device 10 is comprised of a series of three vertically elongated spring fingers 30 which lie alongside the lower region of the magazine casing 18 and are provided with inturned lower ends 32. The latter project through the notches 22 and serve as detents for normally supporting a stack of the chips C which are to be dispensed. It is to be noted at this point that each of the inturned ends 32 of the spring fingers 30 extends inwardly through the notches 22 on an incline which may be on the order of 45° so that downward pressure on the stack of chips C within the magazine will serve, by a camming action, to spread the fingers 30 apart in a manner and for a purpose that will be set forth in detail subsequently. The upper end regions of the spring fingers 30 may be bonded by a suitable adhesive to the outside surface of the tubular magazine casing 18 and, additionally, a retaining collar 34 of suitable elastic material (natural or synthetic rubber) encompasses the upper regions of these fingers and also is bonded thereto, thus securely anchoring the fingers to the magazine body.

Still referring to FIGS. 1 to 3, inclusive, the plunger assembly 16 of the chip-dispensing device 10 is disposed for the most part in the magazine 12, is slidable vertically, and comprises a cylindrical plunger 40 which is preferably formed of lightweight plastic material and embodies a circular bottom face 42 which is adapted to rest on the uppermost chip C in the subjacent stack of chips in the magazine. The plunger 40 is provided at its upper end with an upstanding post 44 (see FIG. 2). The plunger assembly 16 further comprises a metal ferrule consisting of a pair of generally radially extending arms 46 and a connecting bight portion 48. The latter snugly encompasses the post 44 and the ferrule arms 46 projecting radially outwardly through the vertical slot 20 in the magazine body 18. A screw 49 secures the ferrule in position on the post 44. The outer ends of the arms 46 are bent laterally outwards to provide embedment flanges 50 and a major portion of the ferrule exteriorly of the magazine is embedded in a manipulating knob 52 of spherical design.

Figure 4:
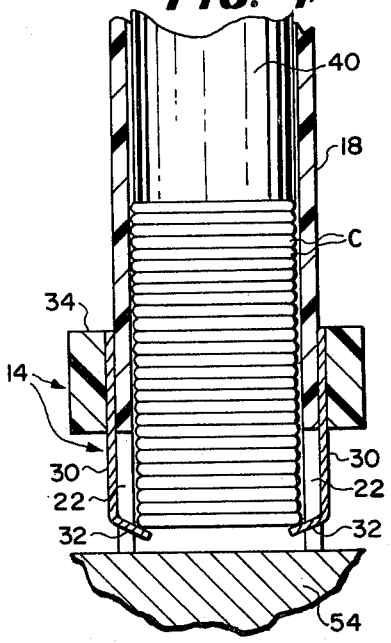
FIG. 4 is a fragmentary sectional view taken on the angular line 4—4 of FIG. 3 and in the direction of the arrows and showing the device in a selected chip-placement location immediately prior to actuation of the plunger of the device for chip-dispensing purposes.

In the operation of the chip-dispensing device 10, when it is desired to place a unit chip C in position on a goven playing area which may be present on a game board such as is fragmentarily indicated by the reference numberal 54 in FIGS. 4, 5 and 6, the device is positioned in an upright position on the game board as indicated in FIG. 4 so that the lower open rim of the tubular magazine casing 18 rests squarely on such board. This positioning of the device may conveniently be carried out while grasping the magazine casing 18 in one hand. As soon as the device is in its thus seated position on the game board 54, the manipulating knob 52 will be depressed, utilizing the thumb of the same hand for this purpose. Depression of the knob 52 will force the plunger 40 downwardly so as to apply downward pressure to the entire stack of chips beneath the plunger, such downward movement of the knob 52 being translated to the plunger through the medium of the radial arms 46 of the ferrule which slide in the elongated slot 20. The downward pressure which is applied to the stack of chips C causes the lowermost chip in the stack to exert a camming action against the inclined inturned ends 32 of the spring fingers 30, thus spreading such ends apart to the position in which they are shown in FIG. 5 and forcing the lowermost chip downwardly past the gate mechanism so that it drops squarely on the game board 54 at the selected location. As best shown in FIG. 5 of the drawings, the lower rim of the tubular magazine body extends downwards beyond the lower edges of the inturned ends 32 of the spring fingers 30 a distance substantially equal to the thickness of a chip C and, consequently, only one chip can be deposited at a time. It is to be noted that in FIG. 5, the arrow is intended to indicate that plunger pressure is effective against the uppermost chip C in the stack so that the entire stack of chips is under compression. Adjacent chips are thus pressed hard against each other so that the inner ends of the inclined ends 32 of the spring fingers 30 come to rest at the interfacial plane which exists between the lowermost chip and the chip next above. Because of the interfacial pressure between these two adjacent chips, the spring fingers 30 remain distended as shown in FIG. 5 until such time as the downward plunger pressure is relieved by release of the manipulating knob 52 of the plunger assembly 16. When plunger pressure is thus relieved, the spring fingers enter between the deposited chip on the game board and the chip next above as shown in FIG. 6, thus picking up, so to speak, the entire stack of chips and elevating it slightly from the chip which has been deposited on the game board. The device may then be withdrawn from the playing surface of the game board 54, leaving the deposited chip exposed and in its proper selected position on the game board.

It is to be noted that in the form of the invention illustrated in FIGS. 1 to 6, inclusive, the portion of the magazine beneath the plunger 40 contains chip C which have been termed herein as active chips in that they are disposed in a stack from which chips are withdrawn one at a time for dispensing purposes. Since the top closure cap 24 is removable from the upper rim of the magazine casing 18, a stack of reserve chips C may be stored within the magazine above the plunger 40, these chips merely riding on the plunger as the same moves either upwardly or downwardly.

In order to load the magazine 12 with chips, the cap 24 may initially be removed from the upper end of the magazine and the entire plunger assembly 16 including the plunger proper 40 and its associated manipulating ferrule and knob 50 slid vertically upwardly so as to remove the same from the magazine. The upper end of the elongated slot 20 is open and, therefore, no obstruction is offered to such removal of the plunger assembly. Thereafter, the stack of active chips C may be introduced into the magazine through the upper end thereof, the plunger assembly replaced, additional reserve chips introduced into the magazine above the plunger assembly, and the cap 24 replaced.

In FIG. 7, a modified form of chip-dispensing device 110 is disclosed. With the exception of the fact that the magazine casing 118 is devoid of a vertical slot such as the slot 20 and is, thus, in the form of a continuous cylinder, and of the further fact that the plunger assembly 114 is devoid of the upstanding post 44 and its associated ferrule 14, 48, 50, the device 110 remains substantially the same as the previously described device 10 and, therefore, in order to avoid needless repetition of description, similar reference numerals but of a higher order have been applied to the corresponding parts as between the disclosures of FIGS. 7 and 2. Additionally, since the gate assembly at the lower portion of the chip-retaining magazine 112 remains substantially the same as the corresponding gate assembly 14 of the device 10, the fragmentary disclosure of FIG. 7 does not disclose such gate assembly.

Referring now specifically to FIG. 7 of the drawings, the plunger 140 is of hollow tubular construction, the cylindrical side wall thereof having an open upper rim which is closed by a removable closure cap 124 and a bottom wall 142. The plunger 140 projects in telescopic fashion into the magazine casing 118 and is slidable vertically therein. The portion of the plunger 140 which projects outwardly and upwardly from the magazine casing 118 is thus directly accessible to the user for plunger-manipulating purposes and, of course, there is no provision for storage of reserve chips. Otherwise, the form of the invention which is disclosed in FIG. 7 remains the same as the previously described form of the invention.

The invention is not to be limited to the exact arrangement of parts shown in the accompanying drawings or described in this specification as various changes in the details of construction may be resorted to without departing from the spirit or scope of the invention. For example, although the clearance openings for the lower inturned ends 32 of the spring fingers 30 are shown herein as being in the form of vertically extending notches which open onto the lower rim of the magazine casing 18, small clearance holes or openings may be employed if desired. Therefore, only insofar as the invention is particularly pointed out in the accompanying claims is the same to be limited.

Having thus described the invention what I claim as new and desire to secure by letters patent is:

1. As a new article of manufacture, a device for dispensing chips or the like one at a time and comprising an elongated, cylindrical, normally upstanding, one-piece, tubular casing formed of rigid material and having an upper open circular rim for insertion and reception of chips and a lower circular rim defining a dispensing opening, said casing being adapted to be positioned vertically on a game board or the like with its lower circular rim in direct engagement with the upper surface of said game board, defining a chip-receiving magazine for maintaining received chips in the form of a stack, and being provided in the lower region thereof with a plurality of circumferentially spaced, vertically extending and elongated notches the lower ends of which open onto and interrupt the continuity of said lower rim of the casing, a plurality of separate, flat, vertically elongated, spring fingers corresponding in number to and partially overlying the notches, having their upper end regions only fixedly secured to the outer surface of the casing at locations directly above said notches such that the remaining portions thereof are free to flex outwards and inwards in an arc, and having the lower end regions thereof bent inwards only so that they project inwardly and downwardly at an angle of approximately 45°, extend through the lower portions of the notches and into the space within the lower circular rim of the casing, and serve to retain the stack of chips in supported relationship and also to engage with a camming action the lowermost chip in the stack, the upper end regions of the spring fingers being positioned at all times directly outwards of the outer periphery of the casing, the lower end edges of the inwardly bent lower end regions of said spring fingers being straight, having the length thereof the same as the width of the spring fingers, and terminating above said lower circular rim of the casing a distance substantially equal to the thickness of a chip, a plunger normally positioned within and slidable vertically in the casing, said plunger being removable through the upper circular rim of the casing in order to permit a stack of chips to be inserted into the magazine, said plunger when normally positioned in the casing having its lower end in engagement with the uppermost chip in the stack, and when forced downwards applying downward pressure to the stack in order to force the lowermost chip into camming engagement with the inwardly bent lower end regions of the spring fingers and thus causing the central and lower end regions of said fingers to flex outwards and allow passage of said lowermost chip only downwardly and onto said game board, and means connected to the plunger and disposed for the most part exteriorly of the casing for use in manually forcing the plunger downwards for chip-dispensing purposes.

2. A chip-dispensing device as set forth in claim 1 and wherein the casing is provided with an elongated vertical slot in the wall thereof above the level of the upper ends of the notches, the slot opening upwardly onto the open rim of the casing, the plunger being wholly disposed within the casing and having on its upper end a vertical post, and the means for use in manually forcing the plunger downwards for chip-dispensing purposes comprising a horizontal manipulating lever which has a portion encircling the post and a radial portion which projects radially outwardly of the plunger and through the vertical slot.

3. A chip-dispensing device as set forth in claim 1 and wherein a removable closure cap is disposed on the upper end of said casing and, in combination with the plunger, establishes an upper magazine section for the storage of reserve chips above the plunger.

* * * * *